United States Patent [19]

Tetenborg et al.

[11] 4,257,209

[45] Mar. 24, 1981

[54] APPARATUS FOR GATHERING THE FLATTENED FILLING ENDS OF FILLED LARGE SACKS BY MEANS OF ZIG-ZAG FOLDING

[75] Inventors: Konrad Tetenborg; Helmut Hüwelmann, both of Lengerich, Fed. Rep. of Germany

[73] Assignee: Windmöller & Hölscher, Lengerich, Fed. Rep. of Germany

[21] Appl. No.: 37,346

[22] Filed: May 9, 1979

[30] Foreign Application Priority Data

May 16, 1978 [DE] Fed. Rep. of Germany ..... 2821279

[51] Int. Cl.[3] ..... B65B 7/06

[52] U.S. Cl. ..... 53/371

[58] Field of Search ..... 53/371, 138 A, 378, 53/375, 379, 387

[56] References Cited

U.S. PATENT DOCUMENTS

| | | | |
|---|---|---|---|
| 2,925,699 | 2/1960 | Ozor | 53/371 |
| 3,115,736 | 12/1963 | Peterson | 53/371 |
| 3,167,897 | 2/1965 | Hopkins et al. | 53/371 X |
| 3,805,489 | 4/1974 | Lieder et al. | 53/371 X |
| 4,162,602 | 7/1979 | Achelpohl et al. | 53/138 A X |
| 4,184,627 | 1/1980 | Achelpohl et al. | 229/60 |

*Primary Examiner*—Horace M. Culver

*Attorney, Agent, or Firm*—Fleit & Jacobson

[57] ABSTRACT

The mouth end of a large filled sack is held taut and flat by holding means. Parallel folding bars extend downwardly from carriers like the prongs of a comb at both sides of the flattened mouth end. The carriers can be moved towards and away from each other, and raised and lowered, so that the folding bars gather or ruffle the mouth end to form a frill and are then withdrawn.

19 Claims, 6 Drawing Figures

FIG. 3
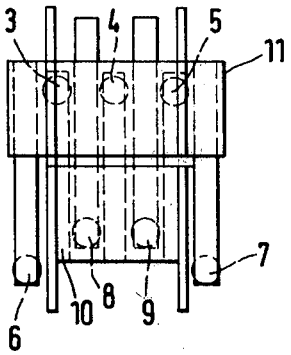
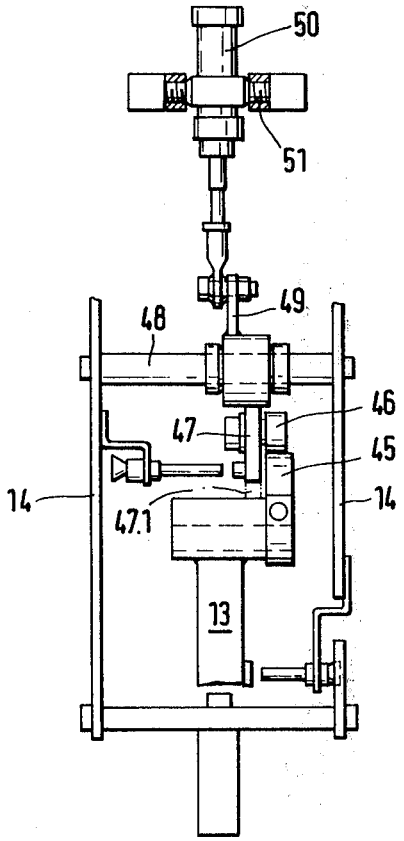
FIG. 6

APPARATUS FOR GATHERING THE FLATTENED FILLING ENDS OF FILLED LARGE SACKS BY MEANS OF ZIG-ZAG FOLDING

The invention relates to an apparatus for gathering the flattened filling ends of filled large sacks by means of zig-zag folding.

DE-OS No. 26 47 432 discloses large sacks made from a tube section of a fabric of plastics threads or plastics tapes coated on the outside or laminated on the outside with plastics film. By reason of their size and the strength of their material, they can hold pourable material with a weight of 1 t and more.

The application filed on Apr. 27, 1978 as a patent of addition to DE-OS No. 26 52 010 describes a method by which such large sacks can be filled and closed fully automatically. According to this method, the large sacks to be filled are first engaged laterally at their open filling end and are opened by pulling the walls of the sack apart before the pourable material is charged into the initially freely suspended sack, the sack is slowly deposited on a support while maintaining its tension in the side walls, and the upper end of the filling aperture is closed by stretching the side walls. The upper end of the flattened filling end turned over sideways through an angle is then closed by a closure strip. An apparatus for folding the superposed walls of the flattened filling ends onto themselves and for welding a closure strip that has been placed onto the folded-over end to project therebeyond to the folded-over end and the adjoining wall of the sack has been described in an application 'Apparatus for folding the flattened filling apertures of large sacks onto themselves and for closing same by closure strips' filed at the same time as this application.

For a complete closure, the upper empty end of the filling end is subsequently re-erected substantially vertically, placed into a zig-zag fold and pulled together to form a frill which is secured against springing open in that the ends of the closure tape projecting from the same side of the frill are welded. The present invention relates to an apparatus for gathering the flattened filling ends of filled large sacks into a frill by zig-zag folding and therefore constitutes one station of the closure equipment for filled large sacks.

It is the problem of the present invention to provide an automatically and reliably operating apparatus of the aforementioned kind with which the closing steps can be terminated by forming the frill.

According to the invention, this problem is solved in an apparatus of the aforementioned kind in that lateral holding means are provided which hold the flattened filling end taut above the sack contents and between which there engage parallel folding bars which extend from above over the filling end from both sides of the plane defined by the holding means and at right-angles to the upper edge of the filling end, the folding bars being secured in the manner of a comb to carriers which can be so moved towards and away from each other that they are interspersed in the gaps formed therebetween, and that the carriers can be raised and lowered. In the apparatus according to the invention, the folding bars pass between each other in the manner of a comb and pull the flattened filling ends together by zig-zag folding. By means of this gathering to form a frill, the flattened filling end is pulled together so that it is first released from the lateral holding means which hold it taut and which, for example as described in the simultaneously filed patent application 'Apparatus for folding the flattened filling apertures of large sacks onto themselves and for closing same by closure strips', may consist of bars which engage laterally through the turned-over filling end and by which the filling end can, after turning over and welding, be erected to a vertical position in which it can be pulled together by the folding bars in the manner described.

The folding bars of each of the two rows of folding bars desirably consist of tubes rotatable about central axes so as to reduce the friction between them and the flattened filling ends. The central folding bar preferably has a stationary wall which locates the central fold and thereby ensures a symmetrical formation of the frill.

After the frill has been formed, the folding bars are pulled out upwardly and then again moved to their lowered lateral position ready for use.

In a further development of the invention, for the purpose of welding the ends of the closure tape projecting from one side of the filling end gathered into a frill, levers carrying welding jaws at their ends are pivotable symmetrically to the vertical plane of symmetry of the folding bars about axes parallel to the bars. Levers carrying clamping bars may be pivotable about the pivotal axes of the levers carrying the welding jaws; they engage between the folding bars and welding jaws and hold the ends of the closure tape together so that it is not subjected to tensile forces during welding.

Other advantageous embodiments of the invention have been described in more detail in the subsidiary claims.

One example of the invention will now be described in more detail with reference to the drawing, wherein:

FIG. 3 is a section on the line III—III in FIG. 2;

FIG. 6 is an elevation of the apparatus in the direction of the arrow X in FIG. 1.

Figure 1:
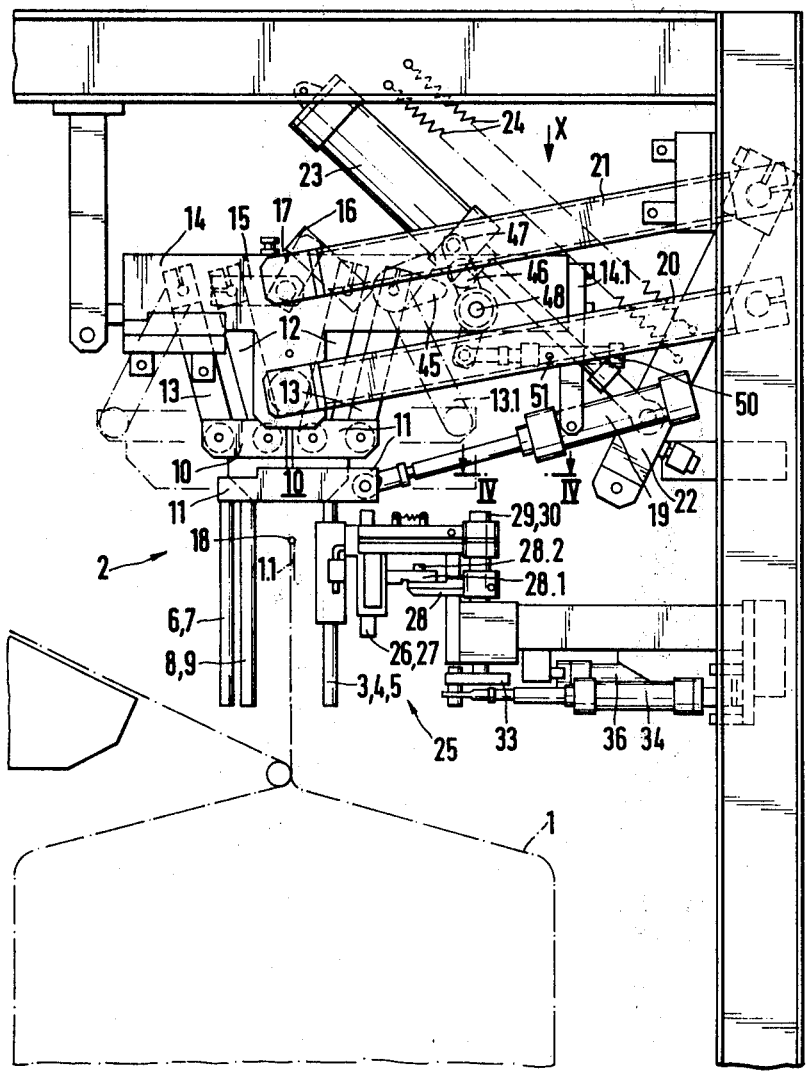
FIG. 1 is a side elevation of the apparatus for gathering the flattened filling ends and for welding the ends of the closure tape in the direction in which the large sack is conveyed through the closing equipment.
Figure 2:
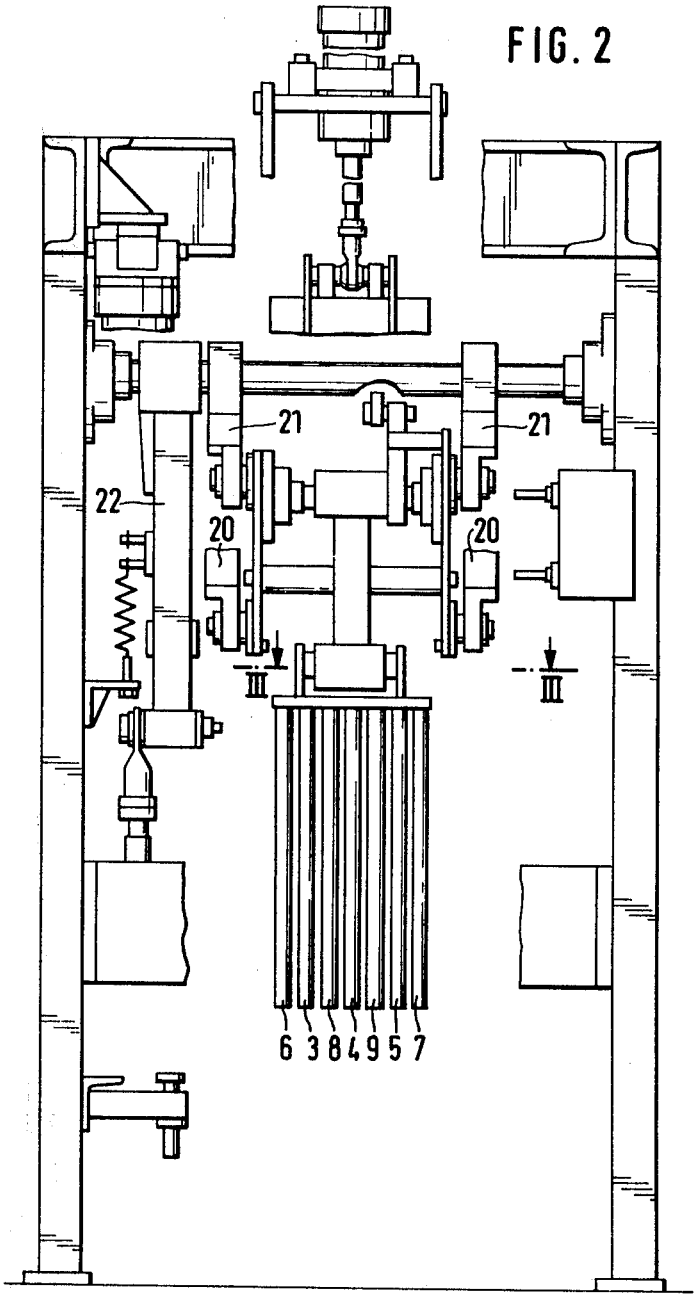
FIG. 2 is an elevation of the FIG. 1 apparatus from the left-hand side.

FIG. 1 is a side elevation of the apparatus for forming frills in filled large sacks of which the filling aperture 1.1 has been folded onto itself by means of the simultaneously filed patent application 'Apparatus for folding the flattened filling apertures of large sacks onto themselves and for closing same with closure strips' and closed by a closure as well as by two weld seams. The closure strips extend over the entire width of the flattened upper sack wall portions and project beyond their fold lines at both sides. To form the frill, the upper sack wall portions had already been brought to a vertical position by lateral bars 18 described in the simultaneously filed patent application 'Apparatus for folding the flattened filling apertures of large sacks onto themselves and for closing same by means of closure strips', the filling aperture again being released from these bars 18 by ruffling during formation of the frill.

The apparatus comprises a folding tool 2 consisting of seven folding bars 3 to 9 which are lowered at both sides adjacent the initially straight filling aperture 1.1 and moved towards each other in this position. They consist of tubes freely rotatable on bolts. The folding bars 6 to 9 are moved from left to right and the folding bars 3 to 5 from right to left.

Figure 4:
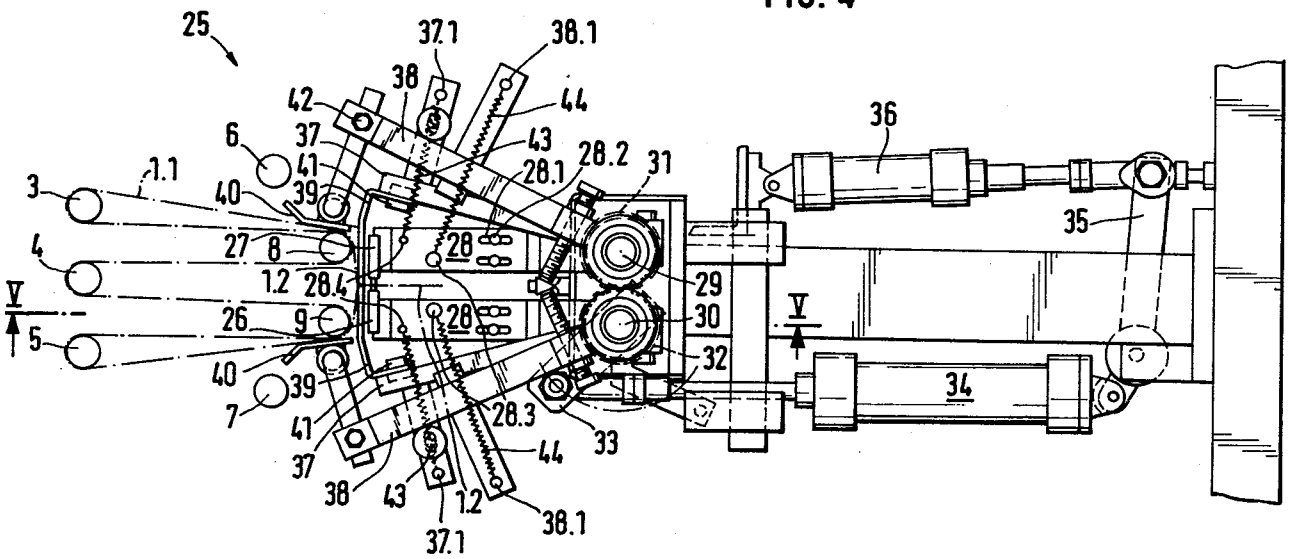
FIG. 4 is a section through the apparatus on the line IV—IV in FIG. 1.
Figure 5:
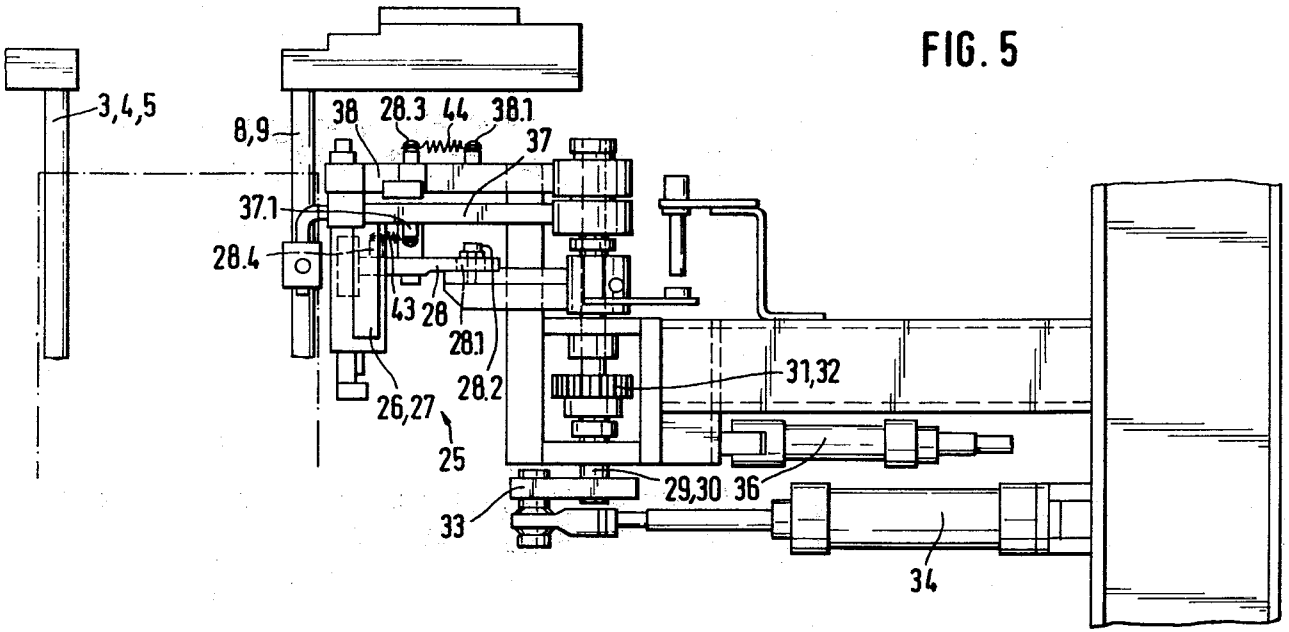
FIG. 5 is a section through the apparatus taken on the line V—V in FIG. 4

After the step of forming the frill, they are withdrawn upwardly out of the frill and moved back laterally to their starting position. The folding bars 3 to 5 are secured to a holder 10 and the folding bars 6 to 9 to a holder 11. The holders 10, 11 function as connectors. They have cranks 12 and swing arms 13 pivoted to them which are loosely rotatably mounted in a frame 14. The cranks 12 are connected to levers 15, 16 to which lugs 17 are so hinged that the cranks 12 can be moved either towards or away from one another. For this purpose the holder 11 is hinged to the piston rod of a piston-cylinder unit 19 which is pivotably mounted on a bar 14.1 of the frame 14. By actuating the piston-cylinder unit 19, the folding bars are moved sideways out of the positions shown in FIG. 1 or 3 into the position shown in FIG. 4.

Cranks 21 and swing arms 20 hinged to the frame 14 are loosely rotatably mounted in the stand of the machine. The piston rod of a piston-cylinder unit 23 is hinged to a lever 22 fixed to the cranks 21 and the cylinder of the unit is pivoted to the stand. By means of tension springs 24 secured to the stand and the lever 22, the weight of the frame 14 and the parts fixed thereto is compensated. By actuating the piston-cylinder unit 23, the folding tool 2 can be lowered and raised. After lowering, the piston-cylinder unit 19 is actuated so that the folding bars 3 to 9 are moved out of the FIG. 1 position into the FIG. 4 position and thereby fold the initially stretched filling aperture 1.1 into a frill shown in FIG. 4.

The folding bars 3 to 9 may extend slightly obliquely to each other so that the frill is wider at the bottom than at the top. This can compensate the difference in thickness caused by folding over of the filling end 1.1.

Folding together of the filling end 1.1 to form a frill causes the bars 18 to be released and they are moved back to their rest position.

A welding tool 25 consists of welding jaws 26, 27 mounted on levers 28. The levers 28 are in two parts, one part being provided with elongate holes 28.1. Both parts are relatively displaceable and can be interconnected by screws 28.2. The levers 28 are secured to shafts 29, 30 which are rotatable in the stand and to which interengaging spur gears 31, 32 are also fixed. A lever 33 keyed to the shaft 30 has the piston rod of a piston-cylinder unit 34 hinged to its free end. The cylinder of the unit is articulated to the shorter lever arm of a double lever 35. The double lever 35 is rotatably mounted in the stand of the apparatus and its other free end is hinged to the piston rod of a piston-cylinder unit 36 of which the cylinder is pivoted to the stand.

Levers 37, 38 loosely rotatable on the shafts 29, 30 carry pressure bars 39 and pressure plates 40 at their free ends, their effective lengths being adjustable by screws 41, 42. The levers 37, 38 are connected to the levers 28 by only diagrammatically indicated tension springs 43, 44 with the aid of bolts 28.1, 28.2 and 37.1, 38.1 secured to these components, so that the movements executed by the levers 28 or the welding jaws 26, 27 are transmitted by the tension springs 43, 44 to the levers 37, 38 and their pressure plates and bars 39, 40. The lengths of the tension springs 43, 44 are dimensioned so that, on actuation of the piston-cylinder unit 34, the pressure plates 40 lie against the folding bars 8 or 9 and the pressure bar 39 presses together the ends 1.2 of the closure strip projecting beyond the fold lines of the large sack 1. As the closure motion progresses, the welding jaws 26, 27 also approach each other and embrace the ends of the closure strip 1.2, the forces exerted by the pressure plates 39, 40 being somewhat increased by further stressing of the tension springs 43, 44. After the welding current has been switched on and off again, the piston-cylinder unit 36 first returns to its starting position so that the welding jaws 26, 27 open or the levers 28 swing back through about 5° out of the welding position. This enables the weld seam to cool off. However, the closure strip is held in the FIG. 4 position by the pressure plates 39, 40 so that the weld seam is not yet subjected to a load. After remaining in this position for a certain time, the piston-cylinder unit 34 is actuated and the levers 28 each swing apart by about 90° so that the pressure plates and bars 39, 40 are also lifted off by the lever 28 by way of abutments acting on their lever.

To enable the folding bars 3, 4, 5 and 8, 9 which are tightly embraced by the filling end 1.1 to be easily withdrawn upwardly after the frill has been formed and the ends of the closure strip have been welded, the holders 10, 11 are moved back by a short distance in the horizontal direction and of their operative position. For this purpose a cam 45 is provided on the lever 13 designated 13.1; it can be locked in the chain-dotted FIG. 1 position reached after formation of the frill by means of a lever 47 rotatably mounted on a shaft 48 or by a roller 46 secured to the lever 47. The lever 47 is moved to the locking position by a piston-cylinder unit 50 which is pivotably mounted in the frame 14 about a shaft 51. Its piston rod is for this purpose hinged to a lever 49 fixed to the lever 47.

After swinging the lever 47 inwardly to the position 47.1, the piston-cylinder 50 is actuated. However, the piston can only return through a shorter distance, namely until the cam 45 abuts the roller 46. In this position, however, the folding bars 3 to 9 have already been retracted so far out of their frill-forming position that they can be easily withdrawn upwardly out of the frill without jamming. They subsequently return to their starting position.

The means executing the individual operating steps are controlled by a sequence control (not shown).

We claim:

1. Apparatus for gathering a flattened filling end of a large sack by forming zig-zag folds in the end comprising:

lateral holding means (18) for holding a flattened filling end of a sack in an upwardly extending position;

first carrier means (10) and second carrier means (11) positioned above the flattened filling end on opposite sides of a plane defined by the flattened filling end;

a plurality of first folding bars (3, 4, 5) secured to and extending downwardly from said first carrier means (10);

a plurality of second folding bars (6, 7, 8, 9) secured to and extending downwardly from said second carrier means (11);

movement means for relatively moving said first and said carrier means between spaced apart positions and positions in which said first folding bars are located in gaps between said second folding bars to thereby form zig-zag folds in the flattened filling end, and for moving said first and second carrier means between lowered positions in which lower ends of said first and second folding bars are positioned below the top of the flattened filling end and raised positions in which the lower ends are positioned above the top of the flattened filling end, said first and said second carrier means being movable into said raised positions after formation of the zig-zag folds to thereby move said first and said second folding bars out of the folds.

2. Apparatus according to claim 1, characterized in that said first and said second plurality of folding bars are arranged in and comprise tubes rotatable about central axes.

3. Apparatus according to claim 2, characterized in that one (4) of said first plurality of folding bars has a stationary wall guided in a medial plane between the lateral holding means (18), the others of said first plurality of folding bars being arranged symmetrically about said one folding bar.

4. Apparatus according to claim 1 or 2, characterized in that outer folding bars (6, 7) of said second plurality of folding bars are arranged to be inwardly offset with respect to the remaining of said second plurality of folding bars.

5. Apparatus according to claim 1 or 2, characterized in that said first and said second carrier means (10, 11) form connectors of four-pivot systems, said movement means comprising said systems and including a frame, and equally long parallel connectors (12, 13) pivoted to said frame and said carrier means.

6. Apparatus according to claim 5, characterized in that two of said parallel connectors (12) have shafts that can be swung towards each other, said movement means including a lug (17) and levers (15, 16) having first ends connected to said two connectors and having second ends so pivoted to lug (17) that the carrier means (10, 11) of each of the two four-pivot systems can be swung parallel to themselves by equal amounts.

7. Apparatus according to claim 1 or 2, further comprising a frame, and characterized in that said movement means includes a piston-cylinder unit (19), and in that one of said carrier means (11) is articulated to one side of said piston-cylinder unit (19) of which the other side is hinged in the frame (14, 14.1).

8. Apparatus according to claim 7, characterized in that the frame (14) forms the connector of a four-pivot system having equally long parallel connectors (20, 21) articulated in a stand of the apparatus.

9. Apparatus according to claim 8, characterized in that said movement means comprises a second piston-cylinder unit (23), and in that a lever (22) has one end secured to a shaft that is connected to one connector (21) of said connectors, the other end of said lever being articulated to one side of said second piston-cylinder unit (23) of which the other end is mounted in the stand.

10. Apparatus according to claim 9, characterized in that springs (24) engage said one connector (21) to balance out the weight thereof.

11. Apparatus according to claim 1 or 2, characterized in that said movement means comprises a frame (14), and cranks (12) and swing arms (13) pivoted to respective ones of said first and said second carrier means and loosely rotatably mounted in said frame, and in that, for loosening the folding bars (3 to 9) from a frill formed in the zig-zag folding created thereby, said movement means includes a roller (46), a lever (47) pivotably mounted in the frame (14) for supporting the roller, and a piston-cylinder unit (50) for pivoting said lever, one of the swing arms (13) mounted in the frame (14) being provided with a cam (45) forming a lever arm cooperating with the roller (46).

12. Apparatus according to claim 1 or 2, characterized in that said apparatus further comprises first levers (28), welding jaws (26, 27) carried at ends of said first levers for pivotable symmetrical movement with respect to a vertical plane of symmetry of the folding bars (3 to 9) about axes parallel to the bars, said welding jaws serving to weld the ends of a closure tape (1.2) projecting from a side of the filling end (1.1) gathered into zig-zag folds forming a frill which faces the first levers.

13. Apparatus according to claim 12, characterized in that said apparatus further comprises second levers (37), clamping bars (39) carried by said second levers and being pivotable about the pivotal axes of said first levers (28) carrying the welding jaws (26, 27), said clamping bars being engaged between the folding bars (3 to 9) and welding jaws (26, 27) and holding ends of the closure tape together.

14. Apparatus according to claim 13, characterized in that said apparatus further comprises third levers (38), and second clamping jaws (40) carried by said third levers and being pivotable about the pivotal axis of said first levers (28) carrying the welding jaws (26, 27), said second clamping jaws pressing side edges of the filling end (1.1) gathered into a frill against two of said second plurality of folding bars (8, 9) for the purpose of holding the frill together during welding of the closure tape.

15. Apparatus according to claim 14, characterized in that said apparatus further comprises a stand, in that said movement means includes shafts (29, 30), and in that said first levers (28) carrying the welding jaws (26, 27) are secured to shafts (29, 30) which are mounted in the stand, and interengaging spur gears (31, 32) for intercoupling said shafts to execute tong-like closing and opening movements of the welding jaws (26, 27).

16. Apparatus according to claim 15, characterized in that said second an said third levers (37, 38) carrying the clamping bars (39) and clamping plates (40) are freely rotatably mounted on the shafts (29, 30), and in that said movement means comprises springs (43, 44) for biasing said clamping bars and said clamping plates towards the levers (28) carrying the welding jaws (26, 27), and adjustable abutments for supporting said second and said third levers on said shafts.

17. Apparatus according to claim 16, characterized in that said movement means comprises a lever, and a piston-cylinder unit (34) having one side articulated to an end of said shaft (30) and one side hinged to the stand.

18. Apparatus according to claim 17, characterized in that said movement means comprises a two-armed lever (35) and a second piston-cylinder unit (36), and in that to produce opening motion of the welding jaws (26, 27) prior to lifting off the clamping plates and bars (39, 40), the piston-cylinder unit (34) is pivoted to one arm of said two-armed lever (35) which is pivotable in the stand and of which the other arm is hinged to one side of said second piston-cylinder unit (36) which has the other side thereof articulated to the stand.

19. Apparatus according to claim 3, characterized in that the outer folding bars are inclined to the central folding bar (4).

* * * * *